US006031493A

United States Patent [19]

Tsuda et al.

[11] Patent Number: 6,031,493

[45] Date of Patent: Feb. 29, 2000

[54] ANTENNA FOR TWO FREQUENCY BANDS

[75] Inventors: Shinichiro Tsuda, Tokyo; Hiroki Ito, Kanagawa; Yoshiki Kanayawa; Shinichi Kuroda, both of Saitama, all of Japan

[73] Assignee: Sony Corporation, Tokyo, Japan

[21] Appl. No.: 08/704,757

[22] PCT Filed: Feb. 7, 1996

[86] PCT No.: PCT/JP96/00253

§ 371 Date: Oct. 2, 1997

§ 102(e) Date: Oct. 2, 1997

[87] PCT Pub. No.: WO96/24965

PCT Pub. Date: Aug. 15, 1996

[30] Foreign Application Priority Data

Feb. 7, 1995 [JP] Japan ..... P7-042314

[51] Int. Cl.[7] ..... H01Q 1/24

[52] U.S. Cl. ..... 343/702; 343/895; 343/900

[58] Field of Search ..... 343/702, 725, 343/729, 895, 900, 901; H01Q 1/24

[56] References Cited

U.S. PATENT DOCUMENTS 5,546,094 8/1996 Egashira ..... 343/702

FOREIGN PATENT DOCUMENTS 0634806 6/1994 European Pat. Off. ..... H01Q 1/24

*Primary Examiner*—Michael C. Wimer

*Attorney, Agent, or Firm*—Jay H. Maioli

[57] ABSTRACT

An antenna unit operating for two frequency bands either when contained or pulled out. A fixed antenna unit 20 and a slide antenna unit 30 are provided. A helical antenna 21 is provided in the fixed antenna unit 20. A first monopole antenna 31 having the same axis as the helical antenna 21, a second monopole antenna 32, and an antenna cover 33 for holding the second monopole antenna 32 on the extended axis of the first monopole antenna 31 are provided in the slide antenna unit 30. The first monopole antenna 31 is held at the position where is not electromagnetically connected to the helical antenna 21 when the slide antenna unit 30 is pulled out, and the second monopole antenna 32 is held at the position where it is electromagnetically connected to the helical antenna 21. Further, the first monopole antenna 31 is held at the position where is electromagnetically connected to the helical antenna 21, and the second monopole antenna 32 is held at the position where is not electromagnetically connected to the helical antenna 21.

8 Claims, 11 Drawing Sheets

ANTENNA FOR TWO FREQUENCY BANDS

TECHNICAL FIELD

This invention relates to an antenna unit suitable for a portable radio terminal used for two frequency bands and a wideband antenna unit for a portable radio terminal.

BACKGROUND ART

Nowadays, with the movement toward small and light-weight portable radio terminals such as portable telephones, an extending whip antenna is attached to those so that it can be contained in the telephone body to improve the portability of the portable telephone in carrying and it can be pulled out from the telephone body in communicating to improve the antenna characteristic.

FIGS. 12 show an example of such an antenna unit: FIG. 12(A) shows the state where an antenna is pulled out from a telephone body, and FIG. 12(B) shows the state where the antenna is contained in the telephone body.

In these Figs., a metal fitting 12 for attaching and detaching the antenna is provided at the upper portion of the box 11 of the portable telephone body and a print distributing board 13 on which circuits are mounted is provided in the box 11. The metal fitting 12 is electrically connected to a high frequency circuit (feeding circuit) 14 on the board 13 via a spring 15.

The antenna body is composed of a fixed antenna unit 20 and a slide antenna unit 30. The fixed antenna unit 20 has a helical antenna 21 and the lower end of the helical antenna 21 is electrically connected to an antenna junction metal fitting 23 through a base 22. Further, the antenna junction metal fitting 23 is screwed in the metal fitting 12.

The helical antenna 21 is covered with an antenna cover 25 having a cylindrical cup shape and formed by insulation material and the opening of this cover 25 is attached to the antenna junction metal fitting 23. Note that, an antenna fixing unit 26 is provided at the center position of the upper end of the antenna cover 25.

An antenna cover 33 is provided so as to freely slide on the wind axis of the helical antenna 21 through the hole of an antenna fixing unit 26 and the hole at the center of the antenna junction metal fitting 23.

Furthermore, at the top of the antenna cover 33, a knob 34 for inserting and pulling out the slide antenna unit 30 is formed in one body, and in the vicinity position of that, a fixing part 35 having larger diameter is formed so that the fixing part 35 is fixed at the center hole of the antenna fixing unit 26 when the antenna cover 33 is contained in the box 11 so as to connect the fixing part 35 and the antenna fixing unit 26. Also, a conductive stopper 41 is attached to the lower end of the antenna cover 33 so that the lower end of a monopole antenna 31 is electrically connected to this stopper 41.

Note that, in FIGS. 12(A) and 12(B), the portion where hatching is not added other than the print distributing board 13 represents that it is made of conductive material.

According to the above structure, the lower end of the helical antenna 21 is connected to the high frequency circuit 14 via a signal path of the base 22—antenna junction metal fitting 23—metal fitting 12—spring 15 to supply electric power by the high frequency circuit 14 so that the helical antenna 21 operates as a transmitting/receiving antenna.

However, as shown in FIG. 12(B), in the state where the slide antenna unit 30 is contained in the box 11, the monopole antenna 31 is located at the position where it is not connected to the high frequency circuit 14 and is not electromagnetically connected to the helical antenna 21; thus the antenna 31 becomes the state where it does not regard transmission and reception.

Accordingly, in this case, transmission and reception, more particularly, reception of call incoming in carrying is conducted only by the helical antenna 21.

On the contrary, as shown in FIG. 12(A), when the slide antenna unit 30 is pulled out from the box 11, the lower end of the monopole antenna 31 is connected to the high frequency circuit 14 through a signal path of the stopper 41—metal fitting 12—spring 15 so as to receive electric power.

Further, in this state, the monopole antenna 31 is positioned on the wind axis of the helical antenna 21 and the top (upper end) projects from the upper end portion of the helical antenna 21 toward the outside. Accordingly, the monopole antenna 31 and the helical antenna 21 operate jointly so that the characteristic as a transmitting/receiving antenna is improved; thus transmission and reception in communicating is performed securely.

In the aforementioned antenna unit, its operation frequency is basically determined according to the antenna length of the helical antenna 21 and the monopole antenna 31. And the antenna unit and the high frequency circuit 14 are matched with each other by providing a matching circuit comprised of a condenser and a coil in the high frequency circuit 14.

By the way, frequency bands used in portable telephones is roughly classified into the following two:

(1) 800 MHz band . . . which is used in all over the world.

(2) 1.5 GHz band . . . which is used in Japan.

1.8 GHz band . . . which is used in Europe or the like.

1.9 GHz band . . . which is used in US or the like.

Therefore, to improve the usability, a portable telephone capable of using for both frequency bands of terms (1) and (2) is required.

However, these frequency bands of terms (1) and (2) are different twice or more from each other. Accordingly, in the case where a portable telephone is used for both frequency bands of terms (1) and (2), two pieces of antennas operating for each frequency band are required.

Although, providing two antennas in one portable telephone is disadvantageous in smallizing considering the small size and light-weighting of a portable telephone, and it is disliked in design. Also, it is inconvenience for a user in that the user must select an antenna in accordance with the frequency band the user would like to use and pull out the antenna in communicating.

Furthermore, for example, with respect to the frequency used in the PDC (personal digital cellular) (800 MHz), the receiving frequency Rx is 810–826 MHz and the transmitting frequency Tx is 940–956 MHz: it is narrow in the respective bands but the frequency interval of each other is extremely large; thus it is difficult to plan such an antenna being resonant with for these both bands by using a general whip antenna, helical antenna or the like.

DISCLOSURE OF INVENTION

This invention solves the above problems, makes one antenna operate for two frequency bands and its antenna characteristic become that for wide band.

By the way, according to the experiment made by the inventors of this invention, it can be confirmed that:

(A) A helical antenna can be resonant with for two frequencies by suitably setting the wind times, the pitch and the wounded diameter.

(B) A monopole antenna is inserted inside the above helical antenna and when the antenna is electromagnetically connected to the helical antenna, if changing the depth inserting the monopole antenna and the antenna length of the monopole antenna, two resonance frequencies can be adjusted.

FIGS. 8 to 11 show the conditions and the experiment result on that experiment.

As shown in FIG. 8, the helical antenna HANT used in the experiment is as follows:

T (wind times) is 6 times,

P (pitch) is 4 [mm], and

D (wind diameter) is 6.5 [mm].

The monopole antenna MANT is as follows:

L1 (length) is 80 [mm], and

L2 (height of the lower end: height from the lower end of the helical antenna HANT) is 0 [mm].

In this state, the frequency characteristic such as shown in FIG. 9(A) can be obtained as to return loss.

Furthermore, when L2 is 9 [mm] without changing the other conditions, the frequency characteristic shown in FIG. 9(B) can be obtained.

That is, according to these measurement result, by inserting the monopole antenna MANT on the same axis in the helical antenna HANT, a resonance point can be obtained for two frequencies and the resonance frequency or the frequency characteristic can be changed.

When measuring the change of a resonance frequency as to the case of L1 is 80 [mm] by setting a height L2 an variable, the result shown by a curvilinear K1 in FIG. 10 can be obtained. When measuring the change of a resonance frequency as to the case of L1 is 30 [mm] by setting the height L2 an variable, the result shown by a curvilinear K2 in FIG. 10 can be obtained.

Further, when measuring the change of a resonance frequency as to the case of L2 is 0 [mm] by setting a length L1 an variable without changing the other conditions, the result shown in FIG. 11 can be obtained.

As the above, said terms (A) and (B) can be confirmed.

This invention can be used for two frequencies based on such experiment fact and can be realized an antenna unit with the antenna characteristic for wide band.

More specifically, this invention structures an antenna unit providing a fixed antenna unit and a slide antenna unit freely in containing: the fixed antenna unit has a helical antenna, and the slide antenna unit has a first monopole antenna which is provided on the same axis with respect to the helical antenna, a second monopole antenna, and an antenna cover for holding the second monopole antenna on the extended axis of the first monopole antenna, and when the slide antenna unit is pulled out, the antenna cover holds the first monopole antenna at the position where the first monopoly antenna does not electromagnetically connect to the helical antenna, and also holds the second monopole antenna at the position where the second monopole antenna electromagnetically connects to the helical antenna, further the antenna cover holds the first monopole antenna at the position where the first monopole antenna electromagnetically connects to the helical antenna, and also holds the second monopole antenna at the position where the second monopole antenna does not electromagnetically connect to the helical antenna, thus electric power is supplied to the first and second monopole antennas through the helical antenna.

In this antenna unit, the helical antenna and the monopole antenna operate jointly corporate for two frequency bands either when contained and pulled out as antennas, further operates as antennas having a wide band characteristic.

According to this invention, antenna operation is conducted for two frequency bands which are largely different from each other and the antenna characteristic is for wide band. Furthermore, the antenna unit to be contained is contained in the telephone body in carrying, and it is used by pulling out in communicating.

Also, it can be precisely adjusted with respect to the two frequency bands. The physical antenna length can be shortened when the antenna is contained. Moreover, the antenna space when the antenna is contained can be reduced, thereby it can contribute to a smaller size of a portable telephone.

DETAILED DESCRIPTION OF PREFERRED EMBODIMENTS

Figure 1A:
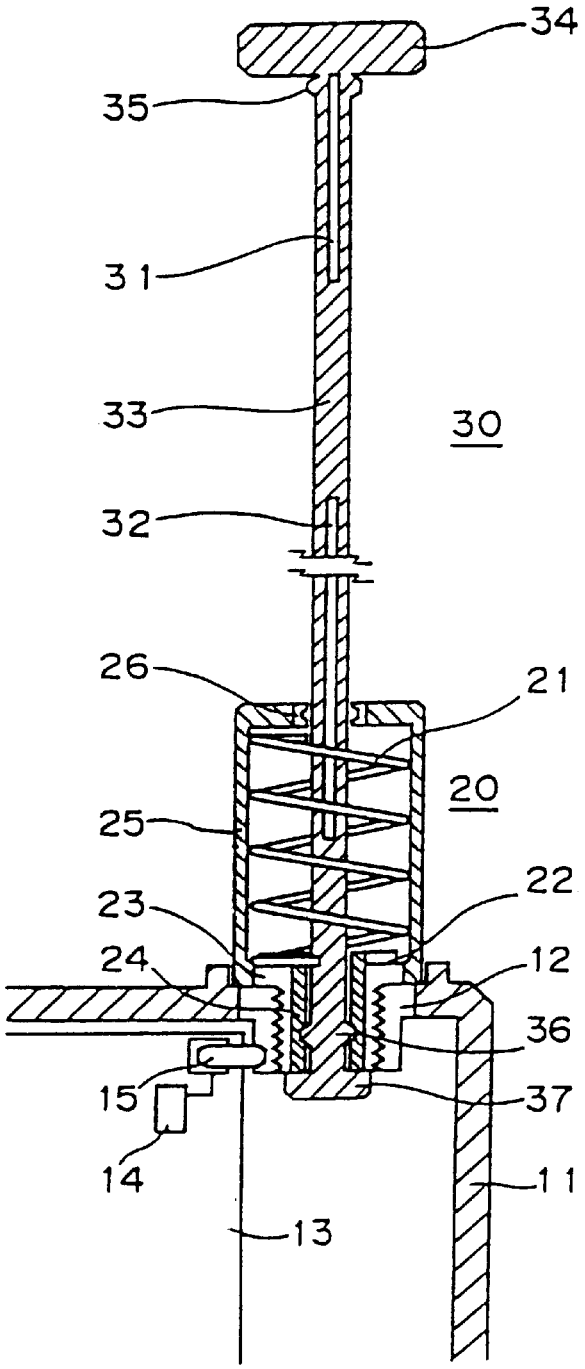
FIGS. 1(A) and 1(B) are sectional views showing a first embodiment of this invention.
Figure 1B:
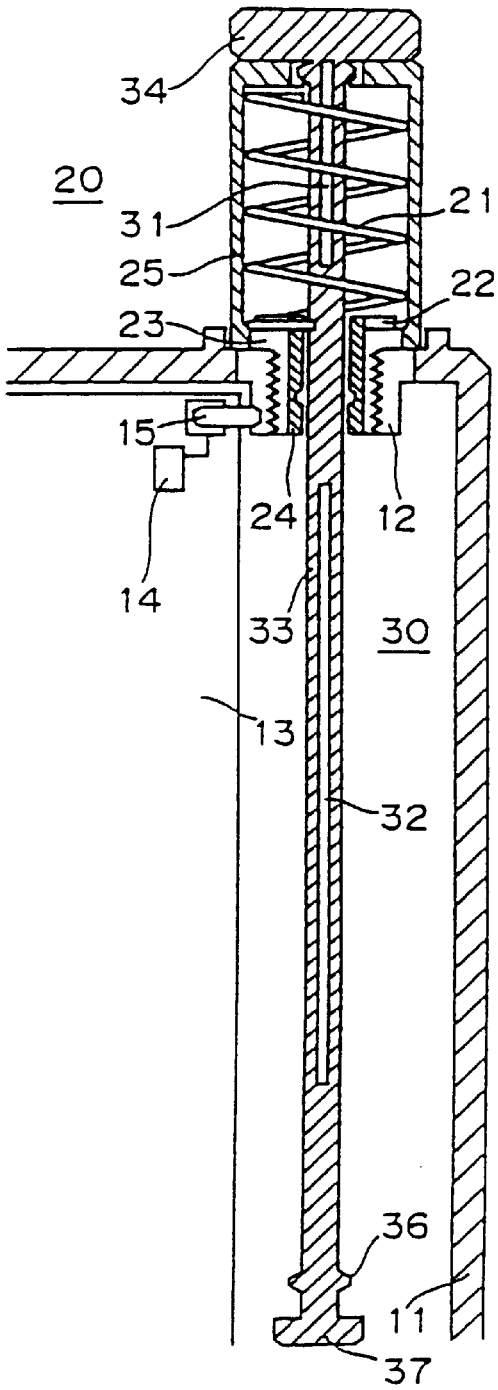

An embodiment of this invention will be described hereinafter, with accompanying drawings:

FIGS. 1 show a first embodiment of an antenna unit according to this invention, in which FIG. 1(A) shows the situation where an antenna is pulled out from a telephone body, and FIG. 1(B) shows the state where the antenna is contained in the telephone body.

In FIGS. 1(A) and 1(B), the box 11 of the portable telephone body is made of insulation material such as plastic material, and a metal fitting 12 for attaching/detaching an antenna, made of conductive material, is provided thereon. Also, a print distributing board 13 on which various circuits are mounted is provided in the box 11. The metal fitting 12 is electrically connected with a high frequency circuit (feed-point circuit) 14 on the board 13 through a conductive spring 15.

The antenna body is composed of a fixed antenna unit 20 and a slide antenna unit 30, the fixed antenna unit 20 has a helical antenna 21. This helical antenna 21 is formed by wound wire material having suitable elasticity and conductivity, for example, a piano wire, in coil shape, and the lower end is electrically connected to an antenna junction metal-fitting 23 through a conductive base 22.

This junction metal-fitting 23 is screwed in the metal fitting 12. Also, the base 22 and the junction metal-fitting 23 have a hole in the wind-axis direction of the helical antenna 21, and an insulation material, the cylindrical insulation cover 24 which is made of, such as plastic material is provided therein.

The circumference of the helical antenna 21 is covered with an antenna cover 25 which has an inverted cup shape and is made of such as plastic material, and the opening of this antenna cover 25 is attached to the antenna junction metal fitting 23. In addition, at the top center position of the antenna cover 25, an antenna fixing unit 26 having a ring shape and made of insulation material is provided.

Besides, the slide antenna unit 30 has monopole antennas 31 and 32, which have suitable elasticity and conductivity and are formed by linear wires, such as nickel wire or titanium wire, of a fixed length. And these monopole antennas 31 and 32 are arranged in parallel in the longitudinal direction with a specified space and the whole of those is molded in an antenna cover 33 which is formed in stick shape and made of such as plastic material.

This antenna cover 33 is provided freely in sliding on the wind axis of the helical antenna 21 through the hole of the antenna fixing unit 26 and the hole of the insulation cover 24 of the antenna cover 25.

Also, at the top (upper end) of the antenna cover 33, a knob 34 for inserting and pulling out this antenna cover 33 is formed in one body by molding, and a wide-diameter fixing part 35 is formed in the vicinity of that, so that the knob 34 is used as an antenna fixing unit when the slide antenna unit 30 is contained in the box 11.

On the contrary, at the lower end of the antenna cover 33, a stopper 37 which is made of insulation material, such as plastic material same as the antenna cover 33 is provided, and a wide-diameter fixing unit 36 is formed in the vicinity of that, so that the stopper 37 is used as a fixing unit when the antenna cover 33 is pulled out from the box 11. Moreover, the insulation cover 24 has a groove for receiving the wide-diameter fixing part 36 at the inner circumference surface.

Note that, in FIGS. 1(A) and 1(B), the portion where hatching is not added other than the print distributing board 13 represents that which is made of conductive material.

According to the above structure, the lower end of the helical antenna 21 is connected to the high frequency circuit 14 via a signal path of the base 22—antenna junction metal fitting 23—metal fitting 12—spring 15 to supply electric power by the high frequency circuit 14 so that the helical antenna 21 operates as a transmitting/receiving antenna in which the grounded patterns of a shield case (not shown) in the box 11 and the print distributing board 13 is used as a ground.

In this case, if the slide antenna unit 30 is contained in the box 11 by pressing the knob 34, the antenna cover 33 is inserted until the position where the knob 34 is touched to the top of the antenna cover 25, as shown in FIG. 1(B), and at the position, the wide-diameter fixing part 35 is connected with the antenna fixing unit 26 so that the state where the antenna cover 33 is inserted is maintained. In this state, the monopole antenna 32 is separated from the helical antenna 21; and so it is not a part of the antenna operation. However, the monopole antenna 31 becomes the state where its lower end is inserted until a fixed depth with respect to the inside of the helical antenna 21, as a result, the monopole antenna 31 is electromagnetically connected with the helical antenna 21 to supply electric power. Further, the upper end of the monopole antenna 31 becomes the state where it projects for a fixed height from the upper end of the helical antenna 21.

Accordingly, the helical antenna 21 and the monopole antenna 31 operate jointly as a transmitting/receiving antenna so that for example, reception of call incoming when carried is conducted.

On the other hand, if the antenna unit 30 is pulled out from the box 11 taking the knob 34, the antenna cover 33 is pulled out until the position where the stopper 37 is reached to the junction metal fitting 23 as shown in FIG. 1(A), and at the position, the wide-diameter fixing part 36 is connected with the groove in the insulation cover 24 so that the state where the antenna unit 30 is pulled out is kept. In this state, the monopole antenna 31 is positioned at the position separated from the helical antenna 21; it has no relation to the antenna operation. However, the monopole antenna 32 becomes the state where its lower end is inserted until a specified depth with respect to the inside of the helical antenna 21, thereby, the monopole antenna 32 is electromagnetically connected with the helical antenna 21.

Further, the upper end of the monopole antenna 32 becomes the state where it projects for a specified height from the upper end of the helical antenna 21. However, in this state, the monopole antenna 32 is insulated direct-currently from such as the junction metal fitting 23 and the metal fitting 12 by the insulation cover 24 or the like.

Thereby, the helical antenna 21 and the monopole antenna 32 operate jointly as a transmitting/receiving antenna. Further, in this state, since the upper end of the monopole antenna 32 is projected from the upper end of the helical antenna 21, total antenna characteristic is improved and transmitting and receiving in communication is performed securely.

Also in the case where the slide antenna unit 30 is contained in the box 11 and the case where the slide antenna unit 30 is pulled out from the box 11, the monopole antenna 31 or 32 is inserted until a specified depth with respect to the helical antenna 21; as a result, antenna function in two frequency bands can be obtained and the frequency bands can be set to purposed frequency bands, as clearly from the aforementioned experiment result. As the above, in this antenna unit, antenna operation can be performed for two frequency bands of which the frequencies are extremely different from each other. Further, closing two frequency bands to each other can obtain wide-band antenna characteristic. Moreover, it is usable such manner that the slide antenna unit 30 is contained in the telephone body when carried, and it is pulled out when talking.

Furthermore, as to these two frequency bands, precise adjustment can be performed. Also, the monopole antenna 31 is also operated as an antenna, so that the physical antenna length can be shortened when the antenna is contained, besides, an antenna space when the antenna is contained can be reduced; as a result, it improves the minimization of a portable telephone.

Further, the antenna cover 33 provides the stopper 37 so that pull intensity when the antenna cover 33 is pulled out can be increased. Besides, the knob 34 also operates as a stopper for preventing that the antenna cover 33 is fallen in the box 11.

The antenna junction metal fitting 23 is attached to the antenna fixing metal fitting 12 by screwing, so that the other antenna can be connected as occasion demands and an adapter for automobile can be connected.

Figure 2A:
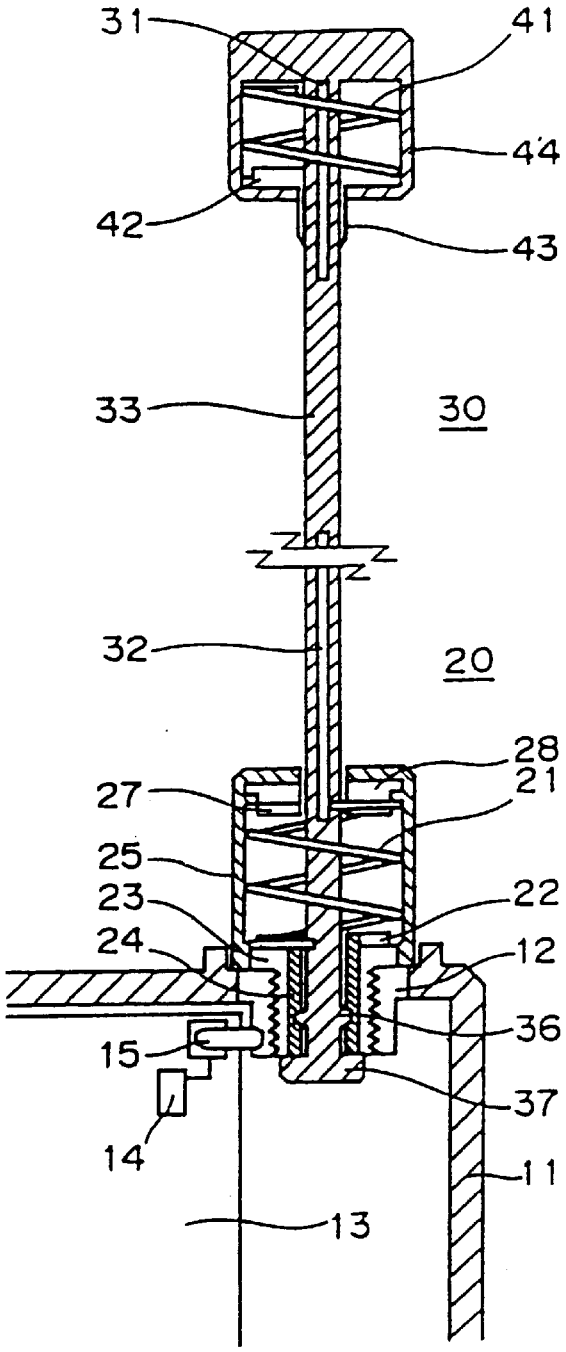
FIGS. 2(A) and 2(B) are sectional views showing a second embodiment of this invention.
Figure 2B:
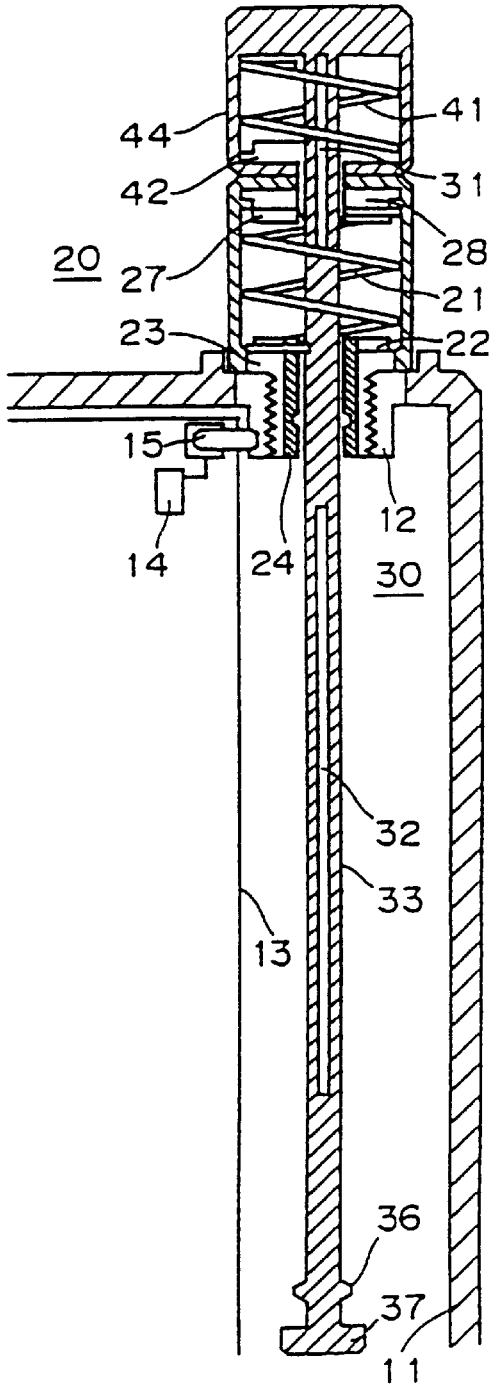

FIGS. 2(A) and 2(B) show the second embodiment of an antenna unit according to this invention. FIG. 2(A) shows the state where an antenna is pulled out from a telephone body and FIG. 2(B) shows the state where the antenna is contained in the telephone body.

Also in this example, the antenna unit is basically structured in similar with the case of the embodiment of FIG. 1, however, at the upper end of the helical antenna 21, a conductive base 27 is added so that it is touched to the antenna 21, and a conductive junction metal fitting 28 is provided thereon.

In addition, a helical antenna 41 is provided at the top of the antenna cover 33. This helical antenna 41 is formed by a conductive wire having elasticity, such as piano wire, and provided so that the wind axis is positioned on the extended line of the wind axis of the helical antenna 21, and the upper end position of the helical antenna 41 is almost similar with the upper end position of the monopole antenna 31 and the lower end of the monopole antenna 31 is projected from the lower end of the helical antenna 41.

Moreover, at the lower end of the helical antenna 41, a conductive base 42 is provided so that it is touched to the antenna 41, and a connecting metal fitting 43 which electrically connects the base 42 and the junction metal fitting 28 in containing is provided along the antenna cover 33. And, an antenna cover 44 which is formed in inverted cup shape with insulation material such as plastic material, is provided so as to cover the helical antenna 41 and the base 42.

According to such a construction, as shown in FIG. 2(A), the helical antenna 21 and the monopole antenna 32 operate jointly as a transmitting/receiving antenna in the case where the slide antenna unit 30 is pulled out, similarly with the case of FIG. 1(A). In this case, the helical antenna 41 and the monopole antenna 31 are positioned at where they are not electromagnetically connected with the helical antenna 21 and the monopole antenna 32 respectively, thus they never operate as antennas.

Accordingly, the helical antenna 21 and the monopole antenna 32 suitably operate for two frequency bands by setting the parameters of the helical antenna 21 and the monopole antenna 32.

On the other hand, as shown in FIG. 2(B), in the case where the slide antenna unit 30 is contained, the helical antenna 21 is connected to the helical antenna 41 via the base 27, the junction metal fitting 28, the connecting metal fitting 43 and the base 42. That is, the electrical antenna length is extended by the helical antenna 41.

Furthermore, in this case, the monopole antenna 31 is electromagnetically connected to the helical antenna 41. However, the monopole antenna 32 is electromagnetically separated from the helical antennas 21 and 41.

Therefore, in this case, the helical antennas 41 and 21 and the monopole antenna 31 are suitably operated for two frequency bands by setting the parameters of the helical antenna 41 and the monopole antenna 31.

In this embodiment, it is arranged that the helical antenna 41 is operated as a part of the antenna when the antenna is contained, therefore, optimal plans for the antenna when pulled out and when contained can be performed respectively.

Figure 3:
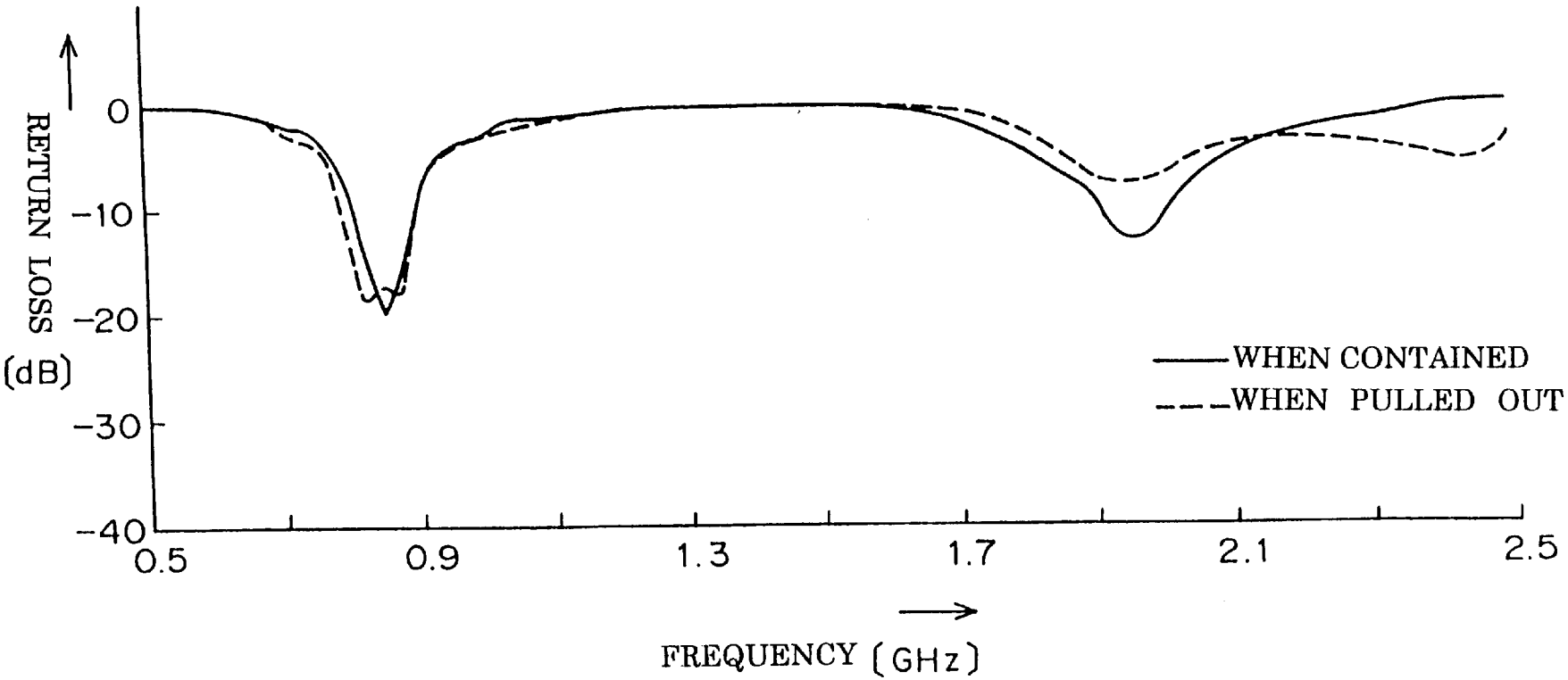
FIG. 3 is a characteristic curvilinear diagram illustrating the characteristic of the embodiment of FIG. 2.

FIG. 3 shows an example of measurement result of the frequency characteristic of return loss of the antenna unit which has been described with FIGS. 2(A) and 2(B). Note that, in this embodiment, it is assumed that:

wind times of the antenna 21 is five times;

total wound times of the antennas 21 and 41 is six times;

the pitch of the antennas 21 and 41 is 4[mm];

the winding diameter of the antennas 21 and 41 is 6.5[mm];

the length of the monopole antenna 31 is 39 [mm]; and the length of the monopole antenna 32 is 55 [mm].

As clearly from this measurement result, the antenna unit of FIGS. 2(A) and 2(B) operates for two frequency bands, 800 MHz and 1.9 GHz, in both the case where the slide antenna unit 30 is contained in the box 11 (shown by a normal line) and the case where the unit 30 is pulled out (shown by a broken line).

Figure 4A:
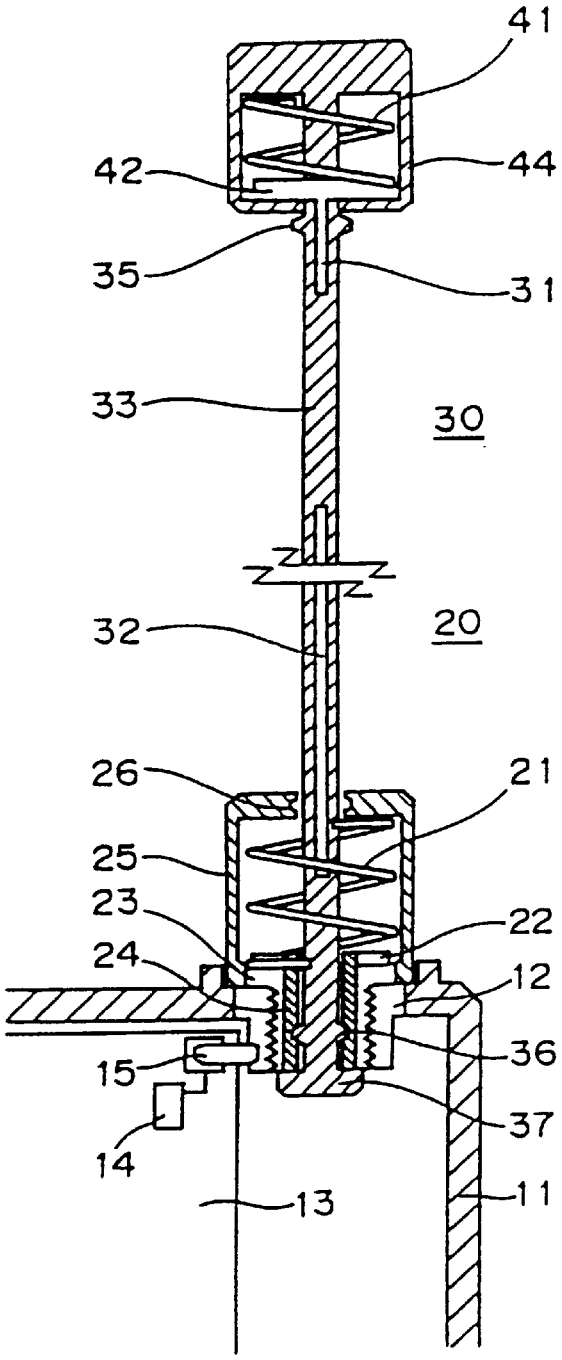
FIGS. 4(A) and 4(B) are sectional views showing a third embodiment of this invention.
Figure 4B:
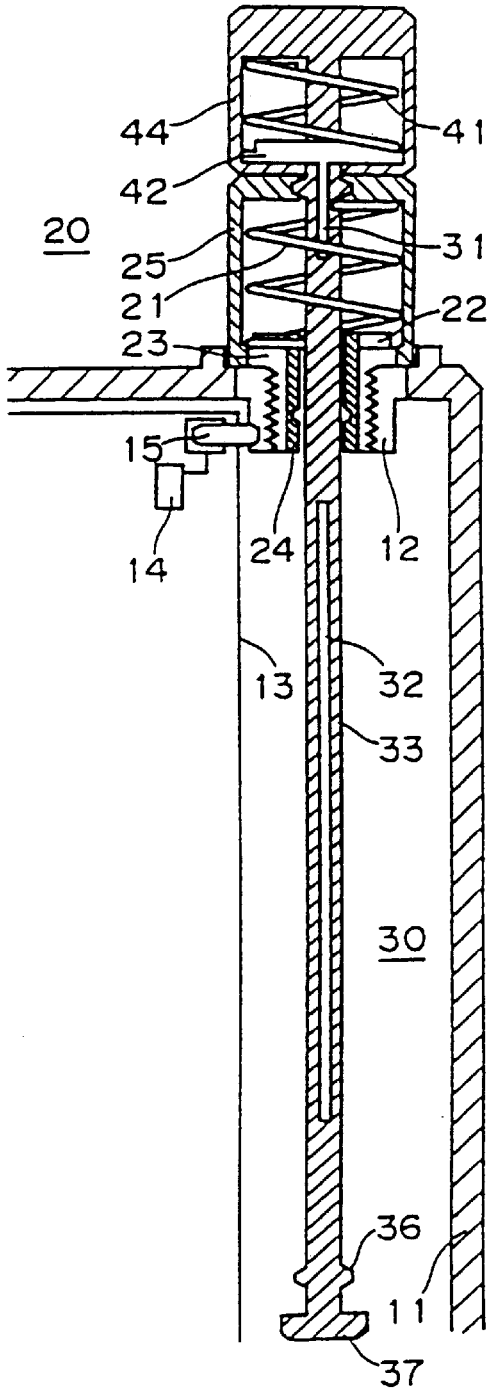

FIGS. 4(A) and 4(B) show the third embodiment of an antenna unit according to this invention. FIG. 4(A) shows the state where an antenna is pulled out from a telephone body. FIG. 4(B) shows the state where the antenna is contained in the telephone body.

In this embodiment, a helical antenna 21 and a monopole antenna 32 are structured similarly with the case of FIGS. 1(A) and 1(B).

Further, a helical antenna 41 is provided at the top of an antenna cover 33 in similar with the embodiment of FIGS. 2(A) and 2(B), and a conductive base 42 is provided at the lower end of the antenna cover 44 and the upper end of a monopole antenna 31 is electrically connected to the base 42.

According to the above structure, as shown in FIG. 4(A), when the slide antenna unit 30 is pulled out from the box 11, the helical antenna 21 and the monopole antenna 32 operate jointly as a transmitting/receiving antenna. At this time, the helical antenna 41 and the monopole antenna 31 are located at the position where they are not connected electromagnetically with the helical antenna 21 and the monopole antenna 32, so that they never operate as antennas.

As a result, the helical antenna 21 and the monopole antenna 32 suitably operate for two frequency bands by setting the parameters of the helical antenna 21 and the monopole antenna 32 previously.

On the other hand, as shown in FIG. 4(B), in the case where the slide antenna unit 30 is contained in the box 11, the helical antenna 41 is connected to the monopole antenna 31 through the base 42, and the monopole antenna 31 is electromagnetically connected to the helical antenna 21. However, the monopole antenna 32 is electromagnetically disconnected from the helical antenna 21.

Accordingly, in this case, the helical antennas 41 and 21 and the monopole antenna 31 suitably operate for two frequency bands by setting the parameters of the helical antenna 41 and the monopole antenna 31 previously.

Also in this example, it is so arranged that the helical antenna 41 operates as a part of the antenna when the antenna is contained; so that optimal plans for the antenna when pulled out and when contained can be performed.

Figure 5A:
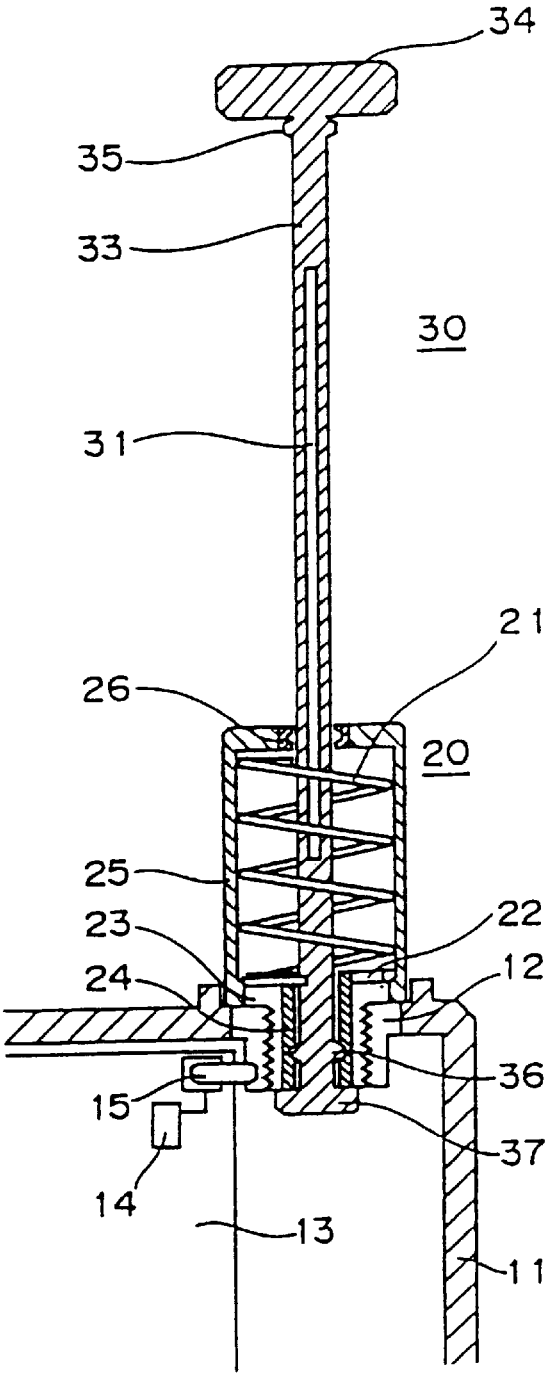
FIGS. 5(A) and 5(B) are sectional views showing a fourth embodiment of this invention.
Figure 5B:
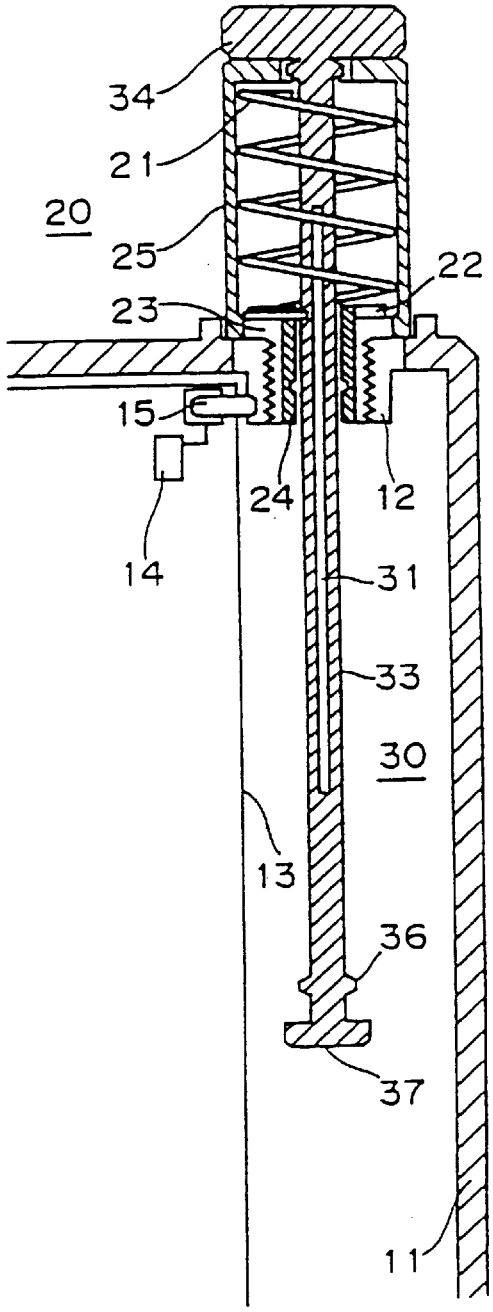

FIGS. 5(A) and 5(B) show the fourth embodiment of this invention: FIG. 5(A) shows the state where an antenna is pulled out from a telephone body and FIG. 5(B) shows the state where the antenna is contained in the telephone body.

Also in this embodiment, the antenna unit is structured similarly with the embodiment of FIGS. 1(A) and 1(B), but is different in the point that an antenna cover 33 provides only a monopole antenna 31.

According to such a construction, as shown in FIG. 5(A), when a slide antenna unit 30 is pulled out, a helical antenna 21 and a monopole antenna 31 operate jointly as a transmitting/receiving antenna in similar with the case of FIG. 1(A). As a result, the slide antenna unit 30 suitably operates for two frequency bands by setting the parameters of the helical antenna 21 and the monopole antenna 31 previously.

On the other hand, as shown in FIG. 5(B), also in the case where the slide antenna unit 30 is contained, the monopole antenna 31 is electromagnetically connected to the helical antenna 21. As a result, the helical antenna 21 and the monopole antenna 31 suitably operate for two frequency bands by previously setting the parameters of the helical antenna 21 and the monopole antenna 31 in this case.

Figure 6A:
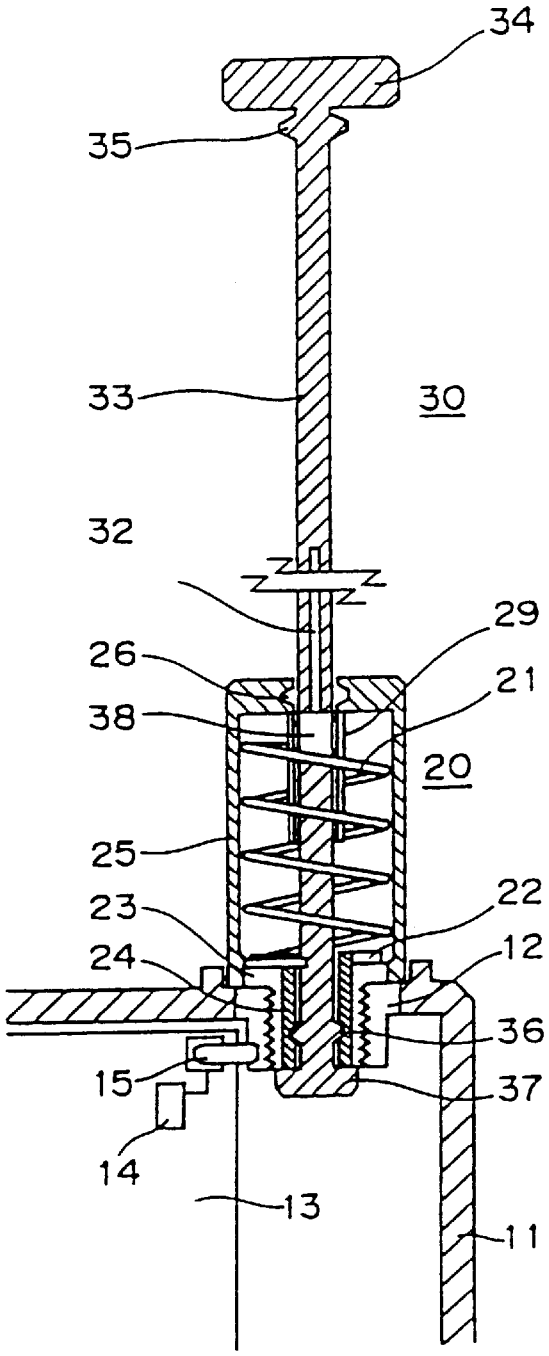
FIGS. 6(A) and 6(B) are sectional views showing a fifth embodiment of this invention.
Figure 6B:
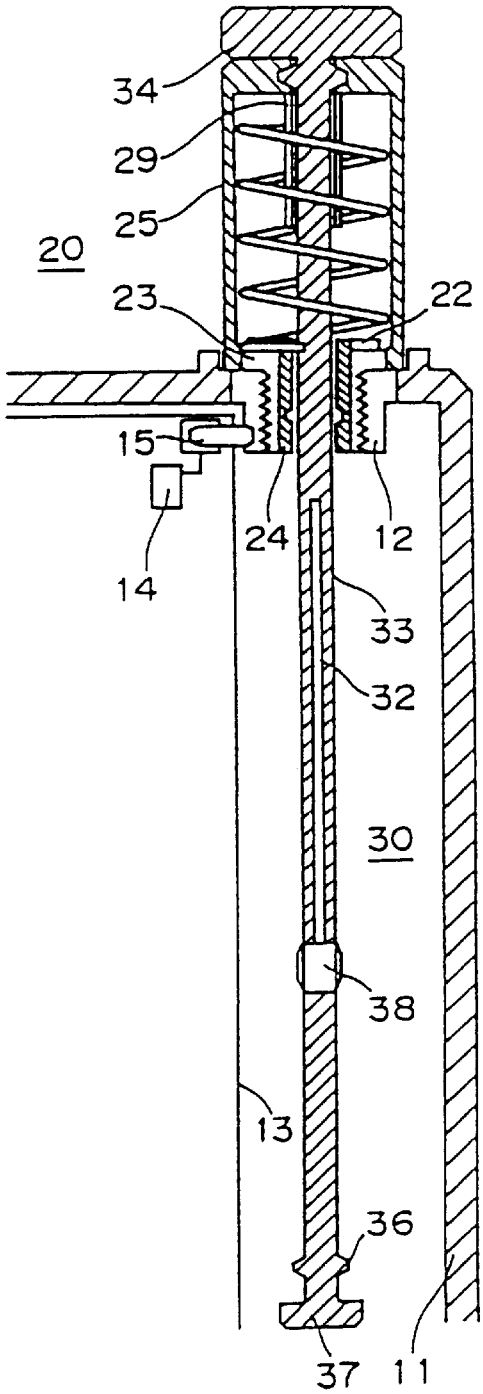

FIGS. 6(A) and 6(B) show the fifth embodiment of this invention: FIG. 6(A) shows the state where an antenna is pulled out from a telephone body and FIG. 6(B) shows the state where the antenna is contained in the telephone body.

Then, also in this embodiment, the antenna unit is structured basically in similar with the embodiment of FIGS. 1(A) and 1(B), however, an empty monopole antenna 29 is fixedly provided in the helical antenna 21. In this case, the empty monopole antenna 29 is formed in pipe shape by conductive material so that it exists on the same axis as the helical antenna 21 so as to surround an antenna cover 33.

Further, the empty monopole antenna 29 is provided so that the upper end projects from the upper end of the helical antenna 21 for a specified height and the lower end is inserted until a specified depth of the helical antenna 21.

Furthermore, a monopole antenna 32 is provided as an antenna at the antenna cover 33, so that a conductive junction metal fitting 38 is electrically connected to the lower end of the antenna 32.

According to such a structure, as shown in FIG. 6(A), when the slide antenna unit 30 is pulled out, the helical antenna 21 and the empty monopole antenna 29 are electromagnetically connected with each other, and the monopole antenna 32 is connected to the empty monopole antenna 29 via the junction metal fitting 38. Therefore, the helical antenna 21, the empty monopole antenna 29 and the monopole antenna 32 operate jointly as a transmitting/receiving antenna for two frequency bands.

On the other hand, as shown in FIG. 6(B), also in the case where the slide antenna unit 30 is contained, the empty monopole antenna 29 is electromagnetically connected to the helical antenna 21. Accordingly, the helical antenna 21 and the empty monopole antenna 29 suitably operate for two frequency bands by previously setting the parameters of the helical antenna 21 and the empty monopole antenna 29 in this case.

Figure 7A:
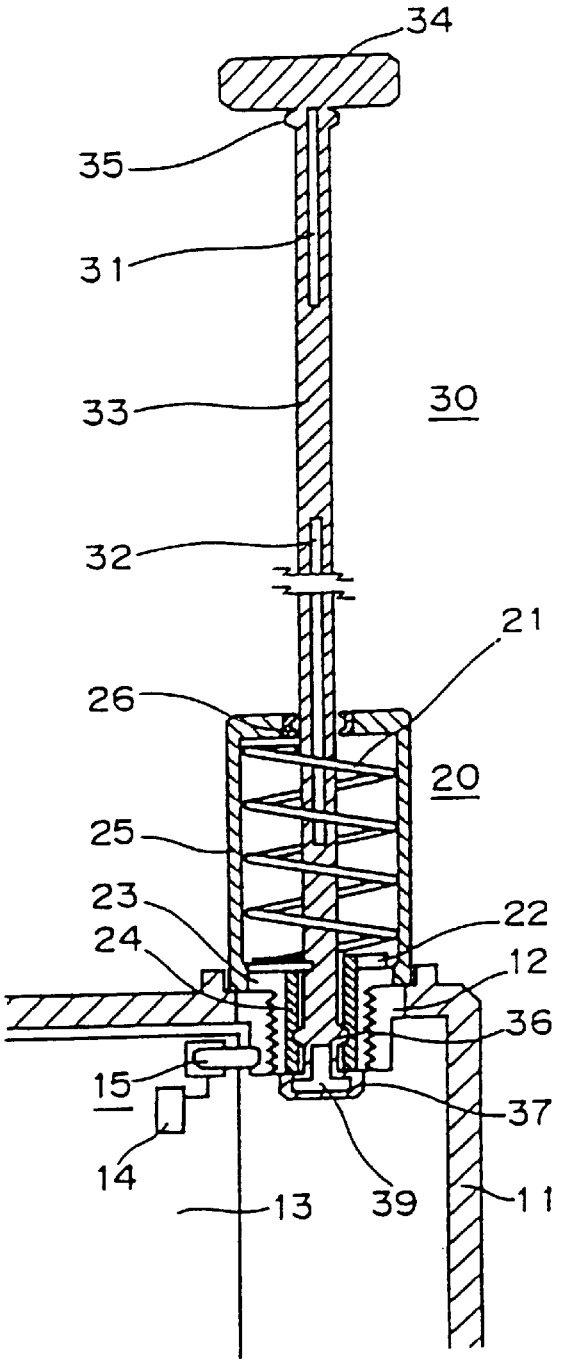
FIGS. 7(A) and 7(B) are sectional views showing a sixth embodiment of this invention.
Figure 7B:
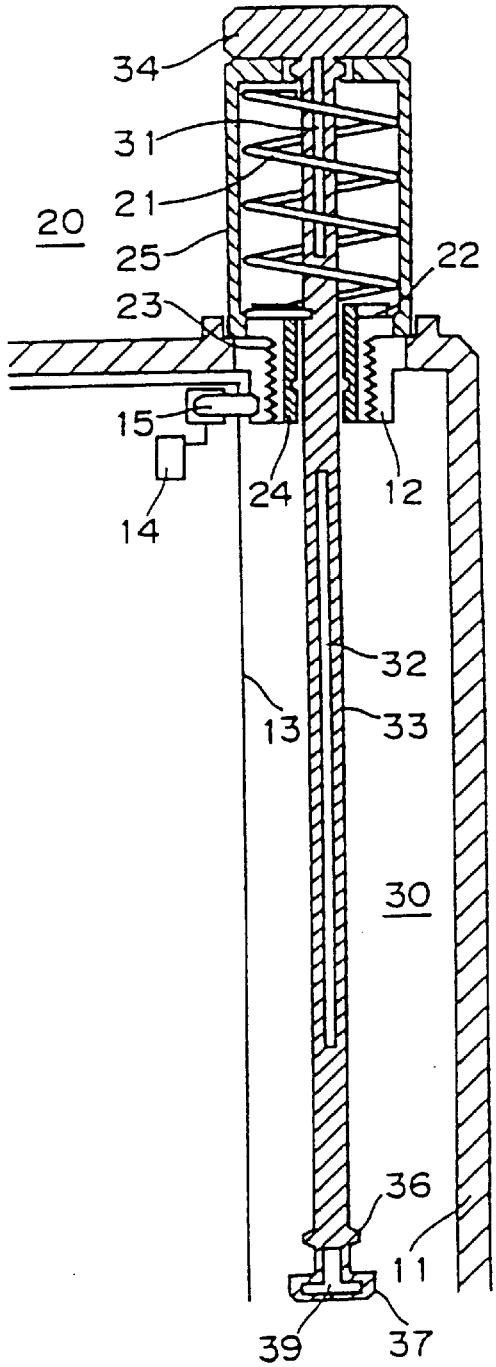
Figure 8:
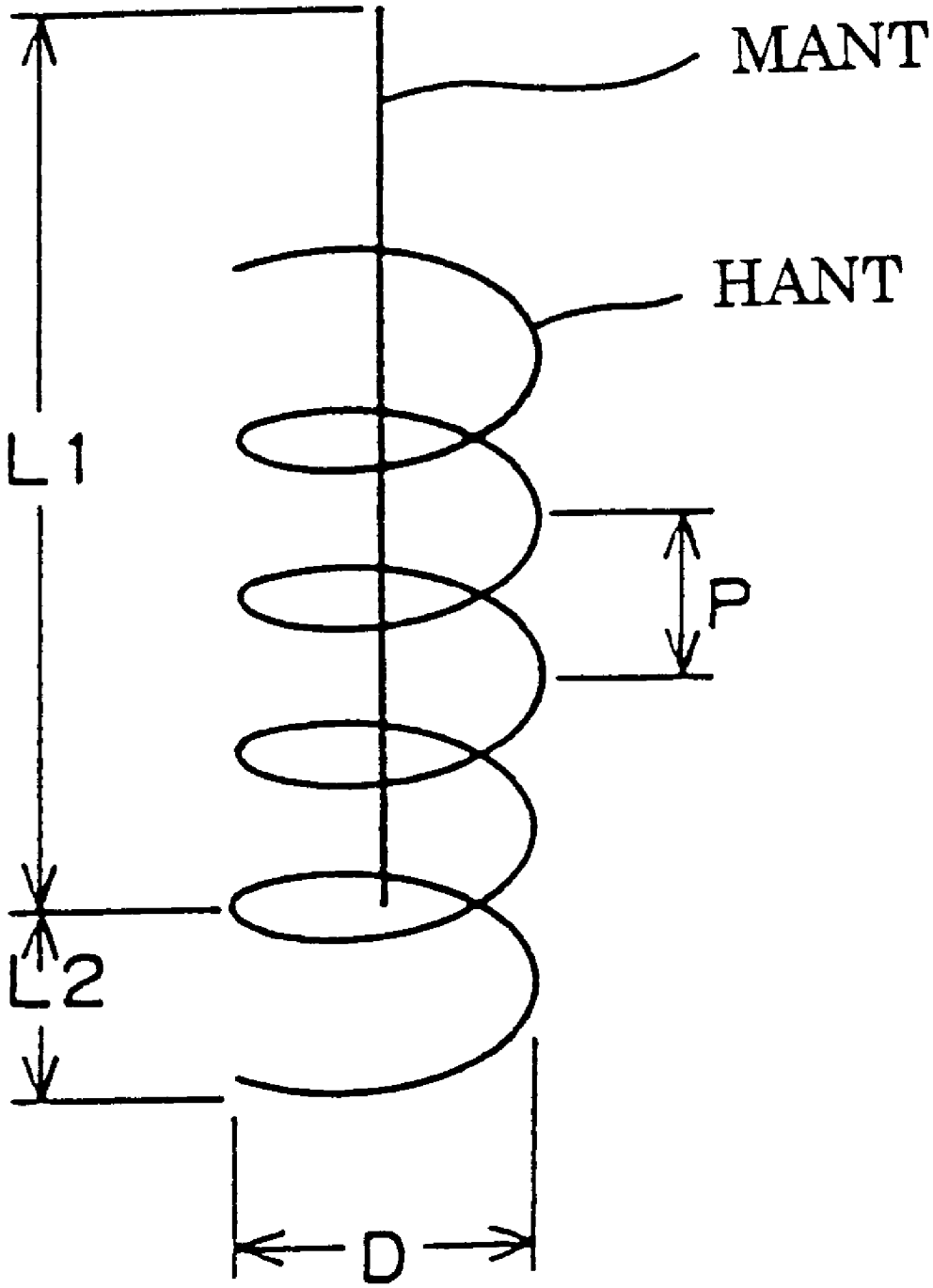
FIG. 8 is a schematic diagram for explaining experiment conditions.
Figure 9A:
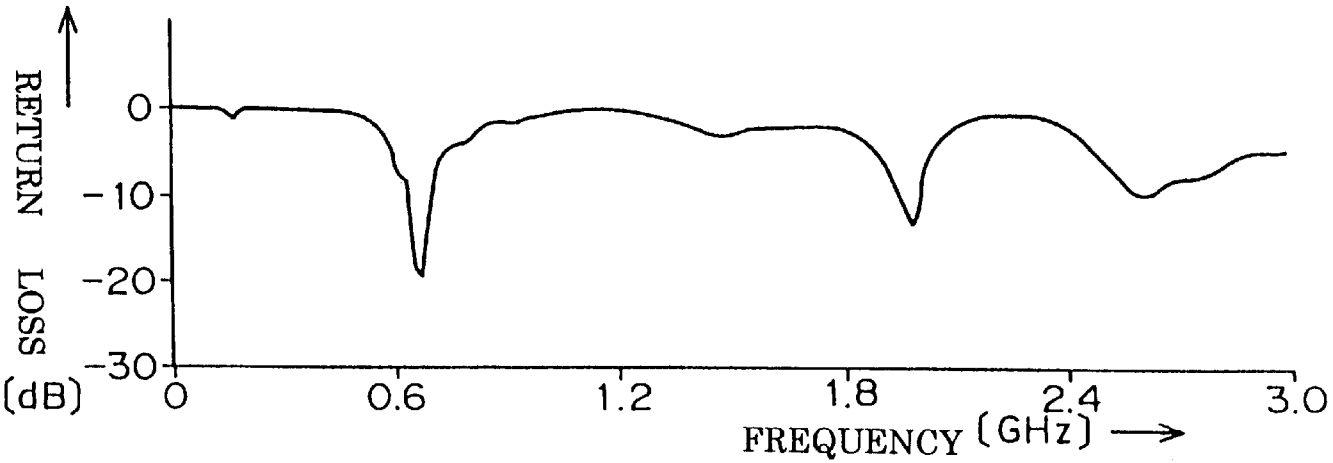
FIGS. 9(A) and 9(B) are characteristic curvilinear diagrams illustrating the first example of the result of the experiment.
Figure 9B:
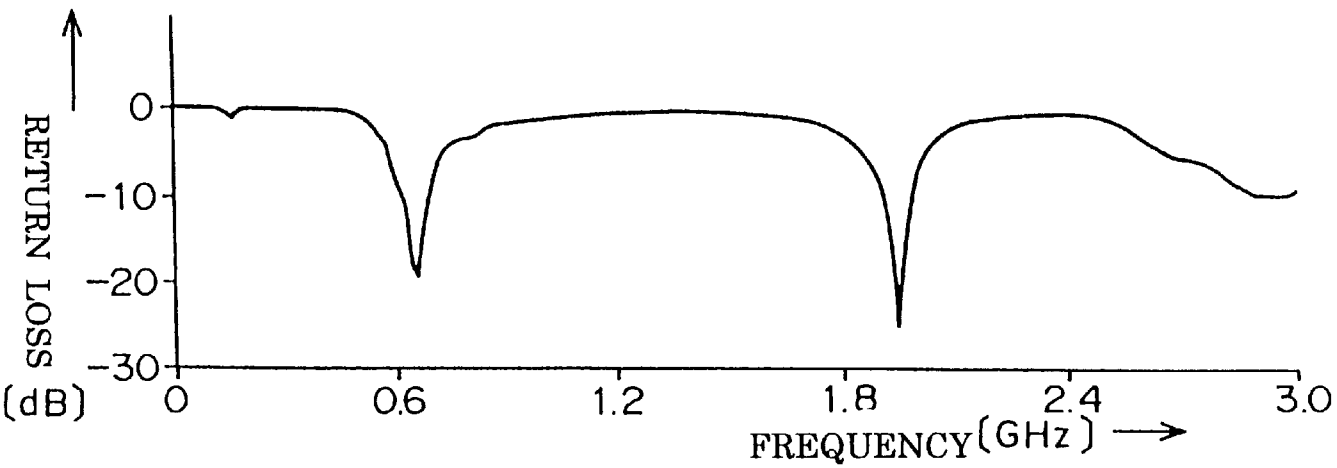
Figure 10:
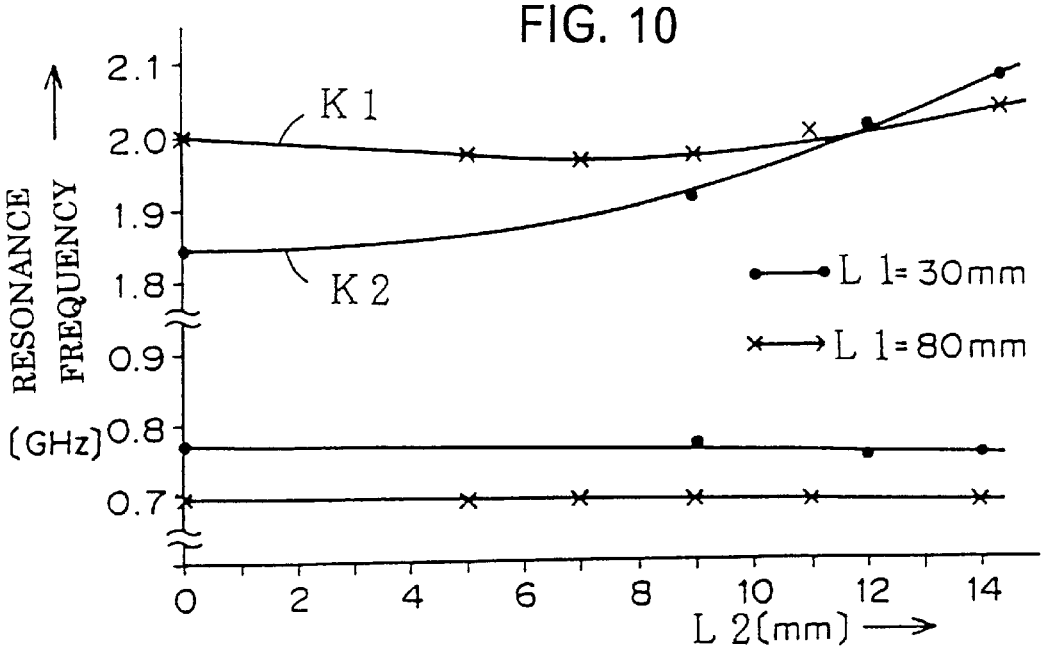
FIG. 10 is a characteristic curvilinear diagram illustrating the second example of the result of the experiment.
Figure 11:
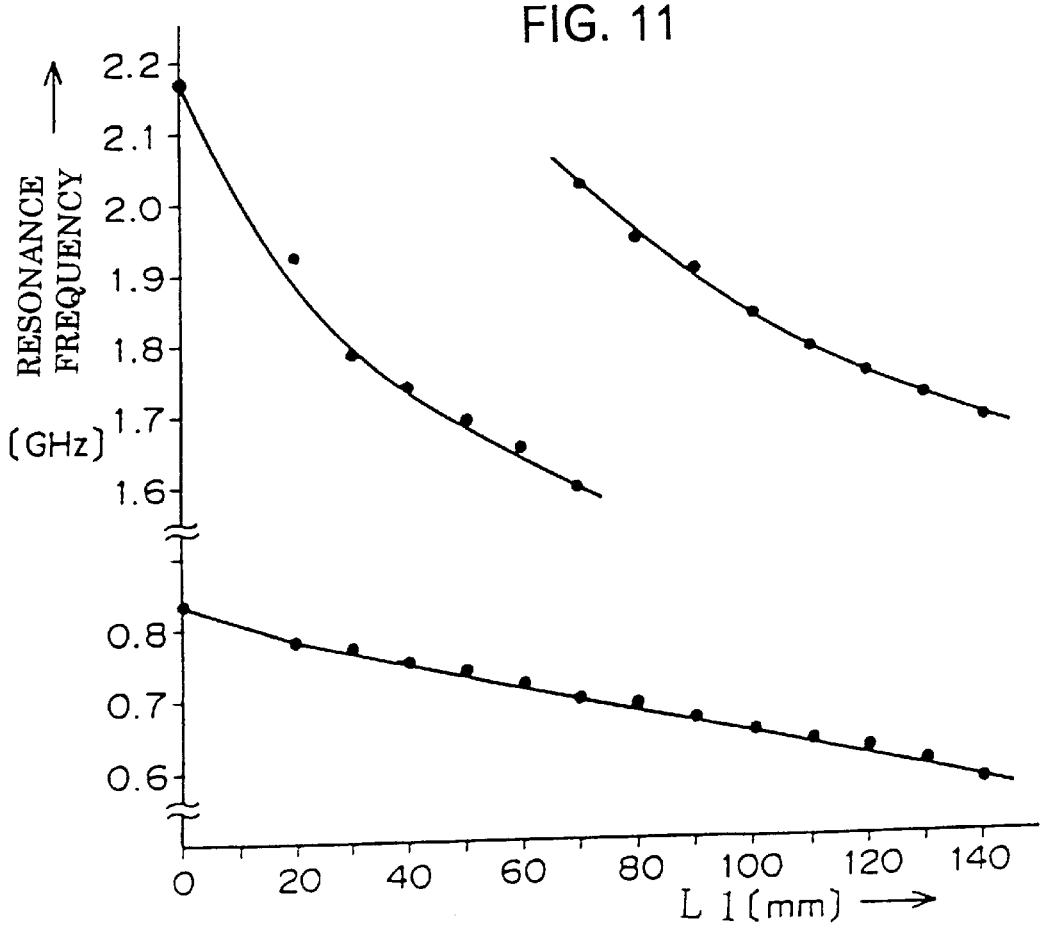
FIG. 11 is a characteristic curvilinear diagram illustrating the third example of the result of the experiment.
Figure 12A:
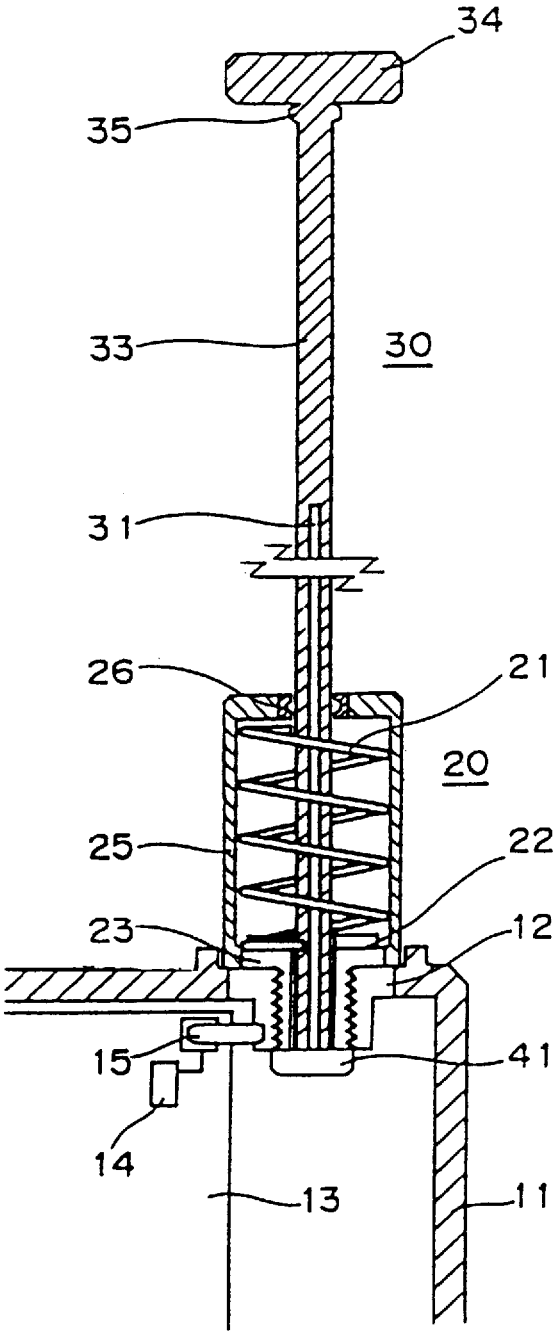
FIGS. 12(A) and 12(B) are a sectional views showing the relevant art for explaining this invention.
Figure 12B:
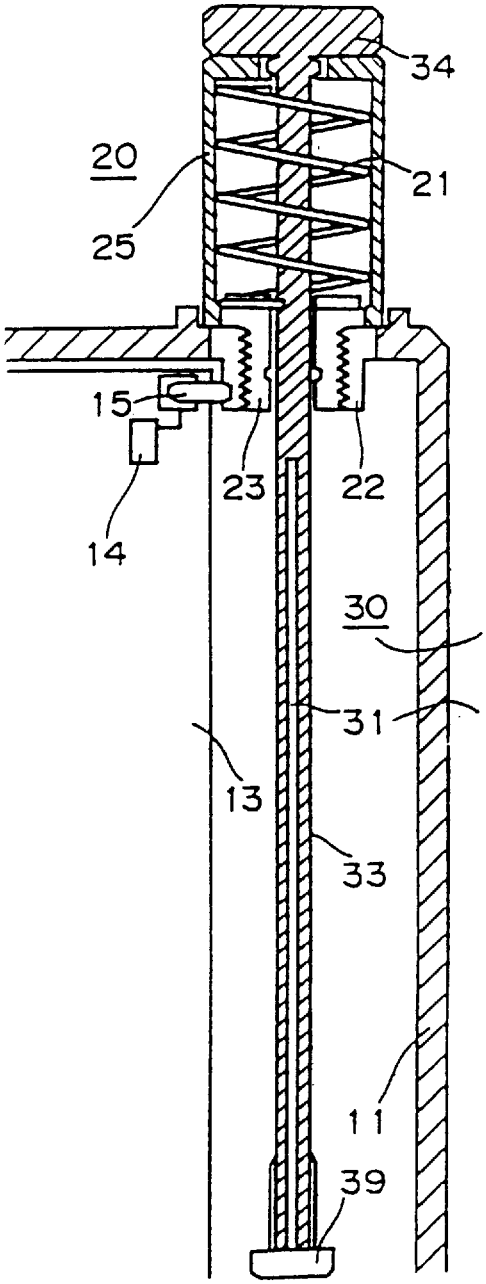

FIGS. 7(A) and 7(B) show the sixth embodiment of this invention: FIG. 7(A) shows the state where an antenna is pulled out from a telephone body and FIG. 7(B) shows the state where the antenna is contained in the telephone body.

In this embodiment, the antenna unit is structured similarly with the example of FIGS. 1(A) and 1(B), however, a metal stopper 39 is provided in the stopper 37 to increase pulling intensity when the slide antenna unit 30 is pulled out. This antenna unit operates as same as the embodiment of FIGS. 1(A) and 1(B).

Note that, the shape of this metal stopper 39 can be modified and also the metal stopper 39 can be applied to the embodiments of FIGS. 2(A) and 2(B), 4(A) and 4(B), 5(A) and 5(B) and 6(A) and 6(B).

An antenna unit according to this invention is applicable to a portable radio terminal such as a portable telephone.

Furthermore, the antenna unit according to this invention is applicable to radio communication equipment which has necessity of antenna operation in the both states where the antenna is contained in the equipment and where the antenna is pulled out from the equipment toward the outside.

We claim:

1. An antenna unit having a fixed antenna unit and a slide antenna unit freely contained in said fixed antenna unit, wherein said fixed antenna unit includes a helical antenna; and said slide antenna unit includes:

a first monopole antenna provided on a same axis as said helical antenna;

a second monopole antenna; and an antenna cover for holding said second monopole antenna on an extended axis of said first monopole antenna; and wherein said first monopole antenna is held at a position where said first monopole antenna is not electromagnetically connected to said helical antenna when said slide antenna unit is pulled out of said fixed antenna unit, and said second monopole antenna is held at a position where said second monopole antenna is electromagnetically connected to said helical antenna when said slide antenna unit is pulled out of said fixed antenna unit;

said first monopole antenna is held at a position where said first monopole antenna is electromagnetically connected to said helical antenna when said slide antenna unit is contained in said fixed antenna unit, and said second monopole antenna is held at a position where said second monopole antenna is not electromagnetically connected to said helical antenna when said slide antenna unit is contained in said fixed antenna unit; and electric power is supplied to said first monopole antenna and said second monopole antenna via said helical antenna.

2. The antenna unit according to claim 1, wherein an antenna length varies according to whether said slide antenna unit is one of contained in said fixed antenna unit and pulled out of said fixed antenna unit.

3. The antenna unit according to claim 1, wherein said slide antenna unit has another helical antenna connected to a part of said first monopole antenna.

4. The antenna unit according to claim 1, wherein:

an upper end of said second monopole antenna projects from said helical antenna at a specified height when said slide antenna unit is pulled out of said fixed antenna unit, and a lower end of said second monopole antenna is inserted in said helical antenna at a specified depth when said slide antenna unit is pulled out of said fixed antenna unit; and a majority of said first monopole antenna is positioned in said helical antenna.

5. The antenna unit according to claim 1, wherein a single monopole antenna replaces said first monopole antenna and said second monopole antenna.

6. The antenna unit according to claim 5, wherein:

an empty monopole antenna is provided on a same axis as said helical antenna; and said single monopole antenna freely slides in said empty monopole antenna in a state wherein said single monopole antenna is electrically connected to said empty monopole antenna.

7. The antenna unit according to claim 2, 3, 4 or 6, wherein a stopper is provided at a lower end of one of said second monopole antenna and said first monopole antenna.

8. The antenna unit according to claim 1, 2, 3, 4, 5, or 6 wherein said antenna unit operates as an antenna for a portable radio terminal.

* * * * *